US007834856B2

(12) United States Patent
Grinshpoon et al.

(10) Patent No.: US 7,834,856 B2
(45) Date of Patent: Nov. 16, 2010

(54) CAPACITIVE SENSE TOGGLE TOUCH DIMMER

(75) Inventors: Michael Grinshpoon, Brooklyn, NY (US); Michael Ostrovsky, Brooklyn, NY (US)

(73) Assignee: Leviton Manufacturing Co., Inc., Melville, NY (US)

( * ) Notice: Subject to any disclaimer, the term of this patent is extended or adjusted under 35 U.S.C. 154(b) by 707 days.

(21) Appl. No.: 11/113,022

(22) Filed: Apr. 25, 2005

(65) Prior Publication Data

US 2006/0055679 A1 Mar. 16, 2006

Related U.S. Application Data

(60) Provisional application No. 60/566,827, filed on Apr. 30, 2004.

(51) Int. Cl.
*G09G 5/00* (2006.01)

(52) U.S. Cl. ..... 345/173

(58) Field of Classification Search ..... 345/173; 178/18.01, 18.06; 315/171, 176, 194, 207, 315/224, 246, 339
See application file for complete search history.

(56) References Cited

U.S. PATENT DOCUMENTS

| | | | | |
|---|---|---|---|---|
| 3,715,623 | A | 2/1973 | Szabo | |
| 3,873,882 | A | 3/1975 | Gershen | |
| 4,163,923 | A | 8/1979 | Herbers et al. | |
| 4,211,959 | A | 7/1980 | Deavenport et al. | |
| 4,360,737 | A | 11/1982 | Leopold | |
| 4,396,869 | A | 8/1983 | Rosenbaum | |
| 4,612,478 | A * | 9/1986 | Payne | 315/176 |
| 4,672,229 | A | 6/1987 | Skarman et al. | |
| 4,695,739 | A | 9/1987 | Pierce | |
| 4,876,498 | A | 10/1989 | Luchaco et al. | |
| 4,954,768 | A | 9/1990 | Luchaco et al. | |
| 5,207,317 | A | 5/1993 | Bryde et al. | |
| 5,208,516 | A * | 5/1993 | Saidian | 315/362 |
| 5,248,919 | A | 9/1993 | Hanna et al. | |
| 5,262,678 | A | 11/1993 | Flowers et al. | |
| 5,283,516 | A | 2/1994 | Lohoff | |
| 5,336,979 | A | 8/1994 | Watson et al. | |
| 5,399,940 | A | 3/1995 | Hanna et al. | |
| 5,485,058 | A | 1/1996 | Watson et al. | |
| 5,621,283 | A | 4/1997 | Watson et al. | |
| 5,637,930 | A | 6/1997 | Rowen et al. | |

(Continued)

FOREIGN PATENT DOCUMENTS

JP 2001-185390 * 7/2001

OTHER PUBLICATIONS

U.S. Appl. No. 60/657,906, Ostrovsky et al., filed Mar. 2, 2005.

(Continued)

*Primary Examiner*—Abbas I Abdulselam
(74) *Attorney, Agent, or Firm*—Weiss & Arons, LLP

(57) ABSTRACT

A touch/toggle dimmer circuit that includes a controller coupled to at least one measurement capacitor whose capacitance is known, and at least one touch pad where the controller is configured by an algorithm to measure changes in the capacitance of the touch pad in response to a user touching the pad. These measurements are used to adjust the power delivered to a load independent of the polarity of the connection between the power source and the dimmer circuit.

18 Claims, 12 Drawing Sheets

U.S. PATENT DOCUMENTS

| | | | | |
|---|---|---|---|---|
| 5,730,165 | A | 3/1998 | Philipp | |
| 6,005,308 | A | 12/1999 | Bryde et al. | |
| 6,169,377 | B1 | 1/2001 | Bryde et al. | |
| 6,380,692 | B1 | 4/2002 | Newman, Jr. et al. | |
| 6,420,669 | B1 | 7/2002 | Shenker et al. | |
| 6,452,514 | B1 | 9/2002 | Philipp | |
| 6,466,036 | B1 | 10/2002 | Philipp | |
| 6,486,616 | B1 | 11/2002 | Liu et al. | |
| 6,535,200 | B2 | 3/2003 | Philipp | |
| 6,686,546 | B2 * | 2/2004 | Chiu | 178/18.01 |
| 6,784,622 | B2 * | 8/2004 | Newman et al. | 315/219 |
| 7,148,704 | B2 * | 12/2006 | Philipp | 324/686 |
| 7,158,125 | B2 * | 1/2007 | Sinclair et al. | 345/173 |
| 7,190,125 | B2 | 3/2007 | McDonough et al. | |
| 7,242,563 | B2 | 7/2007 | Hua et al. | |
| 7,482,758 | B2 | 1/2009 | Hua et al. | |
| 2004/0206616 | A1 | 10/2004 | Leopold et al. | |
| 2006/0012315 | A1 | 1/2006 | McDonough et al. | |
| 2006/0232227 | A1 | 10/2006 | Ostrovsky et al. | |

OTHER PUBLICATIONS

U.S. Appl. No. 60/658,080, Hua et al., filed Mar. 3, 2005.

* cited by examiner

CAPACITIVE SENSE TOGGLE TOUCH DIMMER

This application claims priority of U.S. provisional application having Ser. No. 60/566,827, filed Apr. 30, 2004.

BACKGROUND OF THE INVENTION

1. Field of the Invention

This invention relates generally to electrical lighting control devices and more particularly to a capacitive sense toggle touch dimmer.

2. Description of the Prior Art

A typical dimmer circuit adjusts the power delivered to at least one light bulb in response to a user touching a touch pad actuator. The touch pad actuator is "usually" made from metallic material. A small leakage current flows from the dimmer circuit to the user when the user touches the actuator. This flow causes the capacitance of the touch pad to change and a small voltage drop to develop across the user. A dimmer circuit can measure this change in touch pad capacitance and respond by adjusting, for example, the brightness level as well as the On/Off state of the light bulb. The dimmer circuit includes phase and neutral terminals which have to be connected to respective phase and neutral lines of an alternating current (AC) power source for proper operation. There are various well known techniques for measuring changes in capacitance. However, such techniques may not work properly if the electrical connection between the dimmer circuit and the AC power is reversed. That is, if the polarity of the connection is reversed, (phase line connected to neutral terminal and neutral line connected to phase terminal) then the dimmer circuit may not be able to sense or measure the small leakage current and capacitance changes in the touch pad and thus not operate properly.

It would be desirable to have a dimmer circuit that can operate properly even if the electrical connection between the dimmer circuit and the power source is reversed.

SUMMARY OF THE INVENTION

The present invention provides a new and improved touch/toggle dimmer circuit that includes a controller coupled to a measurement capacitor whose value is known, and also coupled to a touch pad where the controller is configured by an algorithm to measure changes in the capacitance of the touch pad using the measurement capacitor.

In one embodiment, the dimmer circuit includes a controller circuit that measures changes in the capacitance of the touch pad and uses these measurements to control the delivery of power from an alternating current (AC) power source to a load such as a light bulb. The touch pad, which has a capacitance, is connected to the controller through protective circuitry to prevent damage to the controller from undesirable environmental conditions such as static electricity. A measurement capacitor is connected directly to the controller and has a relatively much greater capacitance than the capacitance of the touch pad. The controller operates as a capacitance sensor in that it senses changes in the capacitance of the touch pad caused by a user touching the pad. The controller is configured by an algorithm to measure changes in the capacitance of the touch pad, recalibrate the measurements to offset negative environmental effects and determine whether the changes in capacitance correspond to various events such as a user touching or releasing the touch pad.

The measurement process involves charging the relatively small capacitance of the touch pad and transferring this charge to the relatively larger measurement capacitor. This process is repeated until the measurement capacitor is fully charged and the number of cycles (a cycle is a defined and known time period) it took to fully charge the measurement capacitor is measured. When a user touches the touch pad, the capacitance of the touch pad is changed which affects the amount of time (i.e., number of cycles) it takes to transfer charge from the capacitance of the touch pad to the measurement capacitor to fully charge the measurement capacitor. This change in the time (i.e., change in the number of cycles) is used to determine whether a user has touched or released the touch pad.

The controller of the dimmer circuit is periodically measuring the capacitance of the touch pad based on the number of cycles it takes to fully charge the measurement capacitor. The controller performs an average of the measured capacitance and develops a threshold that helps indicate whether a relatively large or significant change in the touch pad capacitance has occurred. Relatively small changes in the touch pad capacitance are typically due to environmental conditions and other conditions that create stray capacitances. A relatively large change in capacitance may be due to a user touching or releasing the touch pad. When the controller concludes that the touch pad has been touched it then determines whether the touch was a "long touch" or a "short touch."

The controller uses the above information to turn On/Off as well as adjust the brightness of the light. The above measurement (or sensing function) is performed using the I/O pins of a controller without the need for other components such as an analog comparator, thereby reducing the cost and complexity of operation. In addition, because the algorithm is concerned with change in capacitance, the dimmer circuit is capable of operating properly even if the polarity of the electrical connection (phase and neutral lines) between the dimmer circuit and the power source is reversed.

The controller can be configured to receive a zero-crossing signal to synchronize the operation of the controller. The controller can also be configured to generate control signals to an output switching device for controlling a load. In addition, the controller can be configured to provide a signal indicating the status of the controller. The dimmer circuit can include an electrostatic discharge (ESD) protection circuit coupled between the touch pad and the controller. The dimmer circuit can include a current limiting circuit coupled between the touch pad and the controller. The current limiting circuit can include one or more serially connected capacitors.

BRIEF DESCRIPTION OF THE DRAWINGS

Other aspects, features, and advantages of the present invention will become more fully apparent from the following detailed description, the appended claims, and the accompanying drawings in which similar elements are given similar reference numerals.

DETAILED DESCRIPTION OF THE INVENTION

The present invention is directed to a touch/toggle dimmer circuit that includes a controller coupled to a measurement capacitor whose capacitance is known, and also coupled to a touch pad where the controller is configured by an algorithm to measure changes in the capacitance of the touch pad in response to a user touching the pad. These measurements are used to adjust the power delivered to a load independent of the polarity of the connection between the power source and the dimmer circuit.

Figure 1:
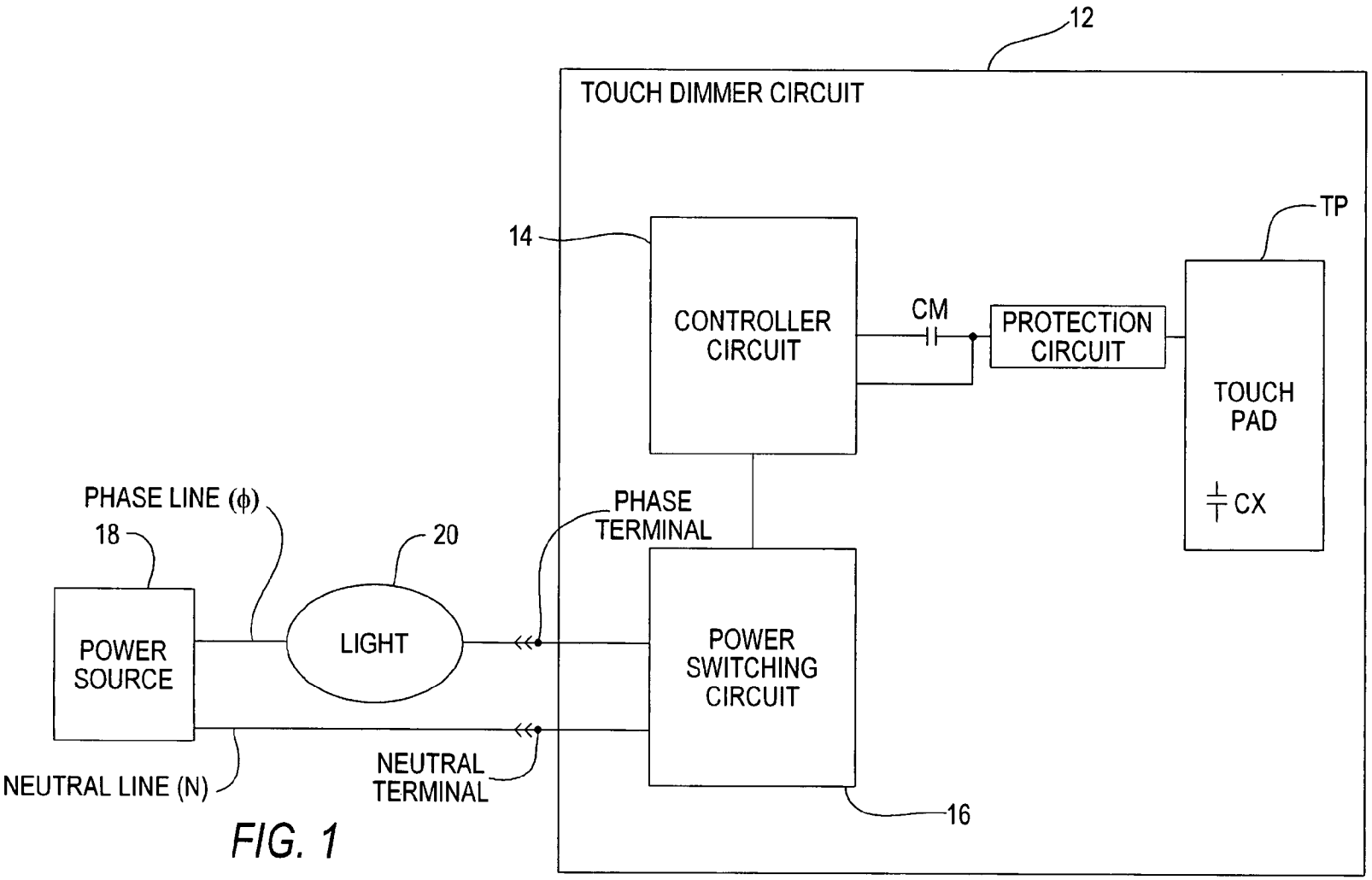
FIG. 1 is a block diagram of a touch dimmer circuit according to an embodiment of the present invention.

FIG. 1 is a block diagram of a capacitance sense touch dimmer circuit 12 having a controller circuit 14 and a power switching circuit 16. The dimmer circuit 12 includes phase and neutral terminals which are connected to respective phase and neutral lines of alternating current (AC) power source 18. The controller circuit 14 measures changes in the capacitance of touch pad TP and uses these measurements to control the delivery of power from the AC power source 18 to a load such as a light bulb 20 which is connected in series between the phase line and the phase terminal. The touch pad TP, which has a capacitance CX, is connected to the controller through protective circuitry to prevent damage to the controller from undesirable environmental conditions such as static electricity. A measurement capacitor CM is connected directly to the controller and has a capacitance that is much greater than the capacitance CX of the touch pad TP. It should be noted that the power source 18 and the light bulb 20 are not part of the present invention and are shown for illustrative purposes only. The capacitance value of measurement capacitor CM is known. Touch pad TP also has a certain nominal capacitance value, but because of its exposure to environmental conditions its capacitance may vary. Further, when touch pad TP is touched by a user, its capacitance will change (most likely increase) due to the capacitance of the user's body. Capacitance CM is selected to have a capacitance that is relatively much greater value than the value of the capacitance of touch pad TP.

The controller circuit 14 operates as a capacitance sensor in that it senses changes in the capacitance of touch pad TP caused by a user touching the pad. In one embodiment, the controller 14 is configured by an algorithm to measure changes in the capacitance CX of the touch TP, recalibrate the measurements to offset negative environmental effects and determine whether the changes in capacitance correspond to various events such as a user touching or releasing the touch pad. The measurement process involves charging the relatively small capacitance CX of the touch pad TP and transferring this charge to the relatively larger measurement capacitance CM. This charging and transferring process is repeated until the measurement capacitor is fully charged. When a user touches the touch pad TP, the capacitance CX of the touch pad is changed which affects the amount of charge across the touch pad. In turn, the change in charge affects the amount of time (number of cycles) it takes to fully charge capacitor CM by transferring the charges from the capacitance CX. The change in the time it takes to charge the measurement capacitor can be used to determine whether a user has touched or released the touch pad.

The recalibration process uses the measurements to calibrate the dimmer to offset environmental effects. The process involves periodically measuring the capacitance of the touch pad based on the number of cycles (a certain defined and known time period) it takes to fully charge the measurement capacitor. The controller performs an average of the measured capacitance and develops a threshold that helps indicate whether a relatively large or significant change in the touch pad capacitance has occurred. Relatively small changes in the touch pad capacitance are typically due to environmental conditions and other conditions that create stray capacitances. A relatively large change in capacitance may be due to a user touching the touch pad. When the controller concludes that the touch pad has been touched it then determines whether the touch was a "long touch" or a "short touch." To detect whether a user has touched the touch pad, the algorithm compares the change between the number of cycles for charging the touch pad TP when it is not touched to number of cycles when the touch pad is touched taking into account changes due to environmental conditions.

This information is useful in determining whether the touch pad has been touched for a "long" or "short" period of time. That is, the process analyzes the relative change in the number of cycles. The controller uses the above information to activate the power switching circuit 16 to turn On/Off as well as adjust the brightness of the light 20. The above measurement (or sensing function) is performed using the I/O pins of a controller (to be discussed below) without the need for other components such as an analog comparator, thereby reducing the cost and complexity of operation. In addition, because the algorithm is concerned with the relative change in capacitance, the dimmer circuit 12 is capable of operating properly even if the polarity of the electrical connection (phase and neutral lines) between the dimmer circuit 12 and the power source 18 is reversed.

Figure 2A:
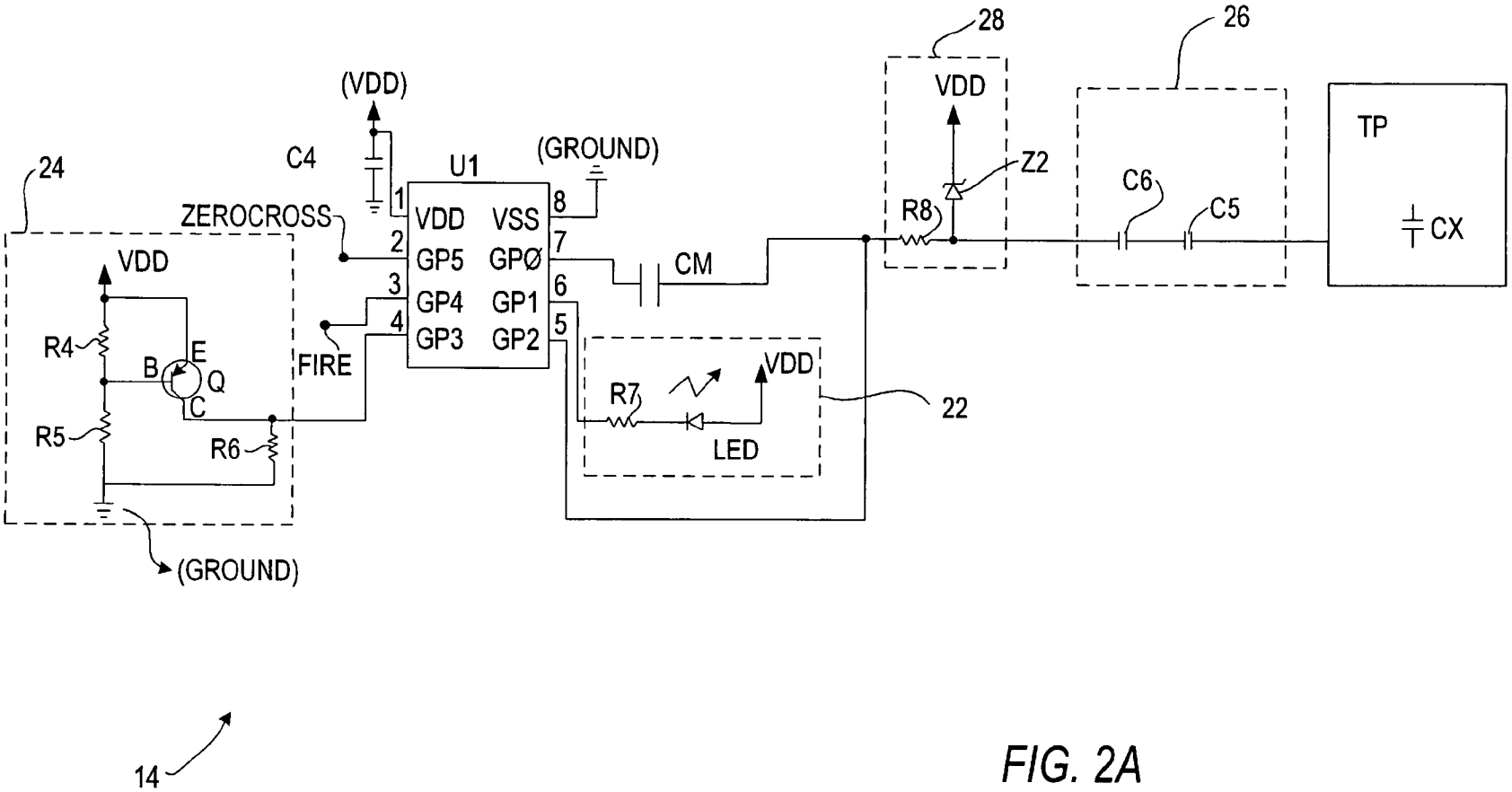
FIGS. 2A and 2B are schematic circuit diagrams of the touch dimmer circuit of FIG. 1 according to a first embodiment of the present invention.
Figure 2B:
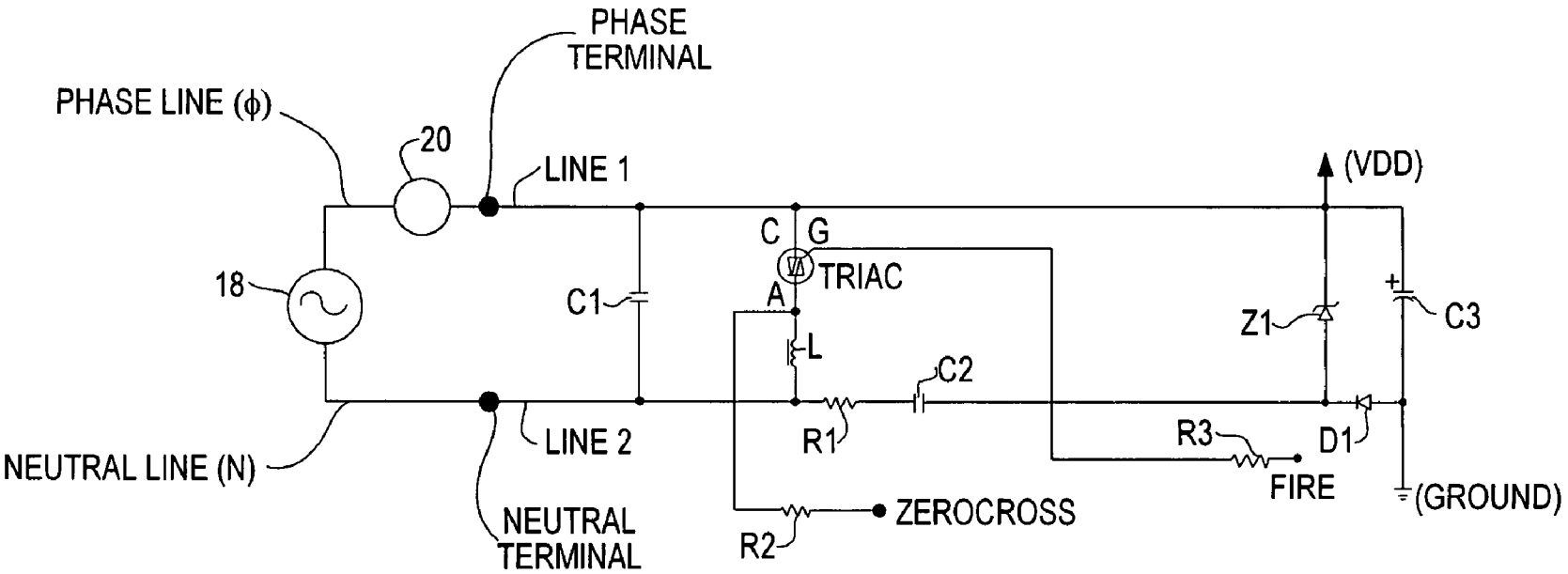

FIG. 2A shows an embodiment of the controller circuit 14 and protection circuit which are used to measure changes in the capacitance of touch pad TP. FIG. 2B shows an embodiment of the power switching circuit 16 for controlling the flow of current from the power source 18 to the load 20 based on the changes in capacitance measurements performed by the controller circuit 14. Referring to FIG. 2A, the controller circuit 14 can be a controller U1 device capable of being programmed to operate according to a set of instructions to perform the techniques of the present invention as explained below in detail. Controller U1 can be a state machine, microcontroller, a microprocessor or other similar controller. Controller U1 has six general purpose or input/output pins (GP0-GP5) that can be configured according to an algorithm or set of instructions executed by the controller. For example, the I/O Pins can be configured as a High-impedance, Input, or Output (High/VDD, Low/Ground). The I/O pins can also set to circuit ground or zero volts.

Measurement capacitor CM is connected across Pins 5 and 7 of controller U1. The touch pad TP is connected to Pin 5 of controller U1 through protection circuits 26, 28. The measurement capacitor CM has a known or predefined capacitance whereas touch pad TP has a capacitance CX that can increase when a user touches the touch TP, by environmental conditions such as stray capacitance or other factors. The touch pad TP can be a conductor, such as a free space metallic touch pad or equivalent means, for providing changes in capacitance with respect to a reference point such as the ground terminal of the circuit.

Controller U1 is powered by a DC power supply by connecting power supply Pin 8 (VSS) to a Ground terminal (Low voltage point) and connecting Pin 1 (VDD) to the DC positive power supply VDD terminal (High voltage point). The DC power supply is provided by the power switching circuit 16 shown in FIG. 2B which is described below. A capacitor C4 is connected across the power supply power terminals (VDD and the Ground terminal) to help improve the characteristics of the DC power supply by reducing the negative impact of ripple/noise. A typical value for capacitor C4 is 0.1 microFarad (uF). Status indicator circuit 22 is connected to Pin 6 of controller U1 to provide status information related to the operation of the dimmer circuit. In one embodiment, the status indicator circuit 22 provides an indication of the status of the dimmer circuit and/or load and includes a light emitting diode (LED) coupled in series with current limiting resistor R7. For example, the LED can be made to blink. Although an LED is shown as a visual status indicator, the indicator can include an audible indicator means such as an audible buzzer and/or other indicator means.

Protection circuit 26 is a current limiting circuit that limits leakage current flowing from the dimmer circuit to touch pad TP. According to Underwriters Laboratory (UL) standard UL-1457 and Canadian Standards Association (CSA) standard CSA-C22.2 No 184-1-95, a current limiting circuit should include two independent limiting means each capable of limiting leakage current below 0.5 mA. In one embodiment, current limiting circuit 26 includes two metalized polyester film capacitors C5, C6 serially connected. A typical value for capacitors C5, C6 is 1500 picoFarad (pF) rated at 250 VAC. Protection circuit 28 is an electrostatic discharge (ESD) protection circuit 28 that is connected between the current limiting circuit 26 and a measurement capacitor CM. When a user touches touch pad TP, ESD may be inadvertently injected into the dimmer circuit, potentially damaging electronic circuits (such as controller U1) within the dimmer circuit. The use of the ESD protection circuit 28 helps reduce such unwanted ESD. In one embodiment, the ESD circuit 28 includes a series resistor R8 and a Zener diode Z2. A typical value for resistor R8 is 10 K ohms and Zener diode Z2 is rated at 27 V. The ESD circuit 28 may include transient voltage suppressor (TVS) diodes or other protection circuitry.

A zero-crossing reference circuit 24 is connected to Pin 4 of controller U1 and provides a reference voltage value for determining the occurrence of zero-crossings of an AC signal from an AC power source. In one embodiment, reference circuit 24 includes resistors R4-R6 and a transistor Q. A typical value for resistor R4 is 15 K ohms, resistor R5 is 75 K ohms and resistor R6 is 30 K ohms. Resistors R4 and R5 are arranged as a voltage divider connected across the DC power supply terminals (VDD and the Ground terminal). Resistor R6 is connected across the collector (C) terminal of transistor Q and the Ground terminal. The base (B) terminal of transistor Q is connected to the mid-point of the R4, R5 resistor network, the emitter (E) terminal of transistor Q is connected to the VDD terminal and the collector (C) terminal of transistor Q is connected to Pin 4 of controller U1. Although switch Q is shown as a transistor, it should understood that the switching function can be performed by any mechanical, electromechanical, semiconductor switching means or a combination thereof. Pin 2 of the controller U1 is connected to a ZeroCross terminal for receiving a zero-crossing signal from power switching circuit 16 of FIG. 2B. The controller U1 uses this signal to generate a clock signal for synchronizing its internal operation as well as for providing a basis for a counter to keep track of the number of AC cycles for the algorithm of the present invention. Controller U1 generates at Pin 3 a trigger signal referred to as a Fire signal to control a power switch (TRIAC) of the power switching circuit 16 as explained below.

The controller is configured by an algorithm to set or program the I/O Pins of controller U1 to measure changes in the capacitance CX of the touch pad TP, use the measurements to calibrate the dimmer to offset environmental effects and determine whether the changes in capacitance correspond to various events such as a user touching or releasing the touch pad. The measurement process involves charging the relatively small capacitance CX of the touch pad TP and transferring this charge to the relatively larger measurement capacitance CM. This charging and transferring process is repeated until the measurement capacitor is fully charged. In one embodiment, in a charge step of the measurement process, the controller U1 sets Pin 7 to a High-impedance state and Pin 5 to a High state which causes charge to flow from Pin 5 to the capacitance CX of touch pad TP. Next, in a transfer step of the measurement process, the controller U1 sets Pin 7 to a Low state and Pin 5 to a High-impedance state which causes the charge on the capacitance CX to be transferred to the measurement capacitor CM. The charge and transfer steps are repeated until the measurement capacitor CM is fully charged. The controller U1 keeps track of the time period (number of cycles) to fully charge the measurement capacitor CM.

A recalibration process helps reduce unwanted environmental factors from impacting the measurement process. The capacitance CX of the touch pad TP is smaller than the measurement capacitor CM and the smaller the value of CX the higher the resolution of the measurement process thus improving the performance of the dimmer circuit. However, this may make the touch pad TP more sensitive to unwanted environmental effects such as stray capacitance. To help offset these undesirable effects, the recalibration process periodically measures the capacitance of the touch pad based on the number of cycles (a certain defined and known time period) it takes to fully charge the measurement capacitor. The controller performs an average of the number of cycles and develops a threshold that helps indicate whether a relatively large or significant change in the touch pad capacitance has occurred. Relatively small changes in the touch pad capacitance are typically due to environmental conditions and other conditions that create stray capacitances. A relatively large change in capacitance may be due to a user touching the touch pad. When the controller concludes that the touch pad has been touched it then determines whether the touch was a "long touch" or a "short touch." To detect whether a user has touched the touch pad, the algorithm compares the change between the number of cycles for charging the touch pad TP when it is not touched to the number of cycles when the touch pad is touched taking into account changes due to environmental conditions. The above measurement (or sensing function) is performed using the I/O pins of a controller without the need for other components such as an analog comparator, switch or an analog-to-digital converter (ADC) thereby reducing the cost and complexity of operation.

Referring to FIG. 2B, power switching circuit 16 includes a bi-directional triode thyristor (TRIAC) having a cathode (C) terminal connected to a first AC power source terminal (Line 1 terminal) and an anode (A) terminal connected to a second AC power supply terminal (Line 2 terminal) through an inductor or coil L. Coil L, capacitors C1, C2 and resistor R1 provide filtering capability and help reduce unwanted magnetic fields generated by the operation of the TRIAC. The TRIAC also has a gate (G) terminal which is connected to pin 3 of the controller U1. The gate terminal is used to control the TRIAC. A typical value for capacitor C1 is 0.15 uF with a rating of 250 V, capacitor C2 is 0.33 uF with a rating of 250 V and resistor R1 is 270 ohms.

The phase terminal of the AC power supply 18 is connected to conductor Line 1 of the circuit 16 through the load 20. The neutral terminal of the power supply is connected to conductor Line 2 of circuit 16. However, it should be noted that the dimmer circuit operates independent of the polarity of the electrical connection between the circuit 16 and the power source 18. For example, the dimmer circuit would still operate correctly even if the phase terminal of the AC power supply was connected to conductor Line 2 and the neutral terminal of the power supply was connected to conductor Line 1. This is achieved by the technique of the present invention including measuring changes in the capacitance CX of the touch pad with respect to a ground point instead of measuring changes in capacitance with respect to the phase and the neutral terminals of the AC source.

The Fire terminal is connected to the gate (G) terminal of TRIAC through current limiting resistor R3. The controller U1 (FIG. 2A) sends a trigger signal over the Fire terminal to control the conduction of the TRIAC. In turn, the conduction of the TRIAC controls the current flow from the power source 18 to the light bulb 20 thereby controlling the state and brightness of light bulb 20. A typical value for resistor R3 is 100 ohms. Although a TRIAC is shown as the power switching device, another device such as a metal-oxide-silicon field effect transistor (MOSFET) or insulated gate bipolar transistor (IGBT) can be used. The anode (A) terminal of TRIAC is also coupled to the ZeroCross terminal through a current limiting resistor R2. A typical value for resistor R2 is 680 K ohms. The ZeroCross terminal provides the AC signal from the AC power source 18 to Pin 2 of controller U1 (FIG. 2A). As explained above, the signal is used to perform a "zero-crossing" synchronization function for detecting the occurrence of zero-crossing of the AC signal (the zero point in an AC cycle).

The DC power supply described above is provided by a DC power supply circuit comprising Zener diode Z1, capacitor C3 and diode D1. The DC power supply circuit receives an AC power signal from the AC source 18 and converts the AC signal to a DC power signal (across VDD and Ground terminals), such as +5 VDC, for powering the dimmer circuit. A typical value for capacitor C3 is 220 uF rated at 10 V and Zener diode Z1 has a rating of 5.5 V.

Figure 3:
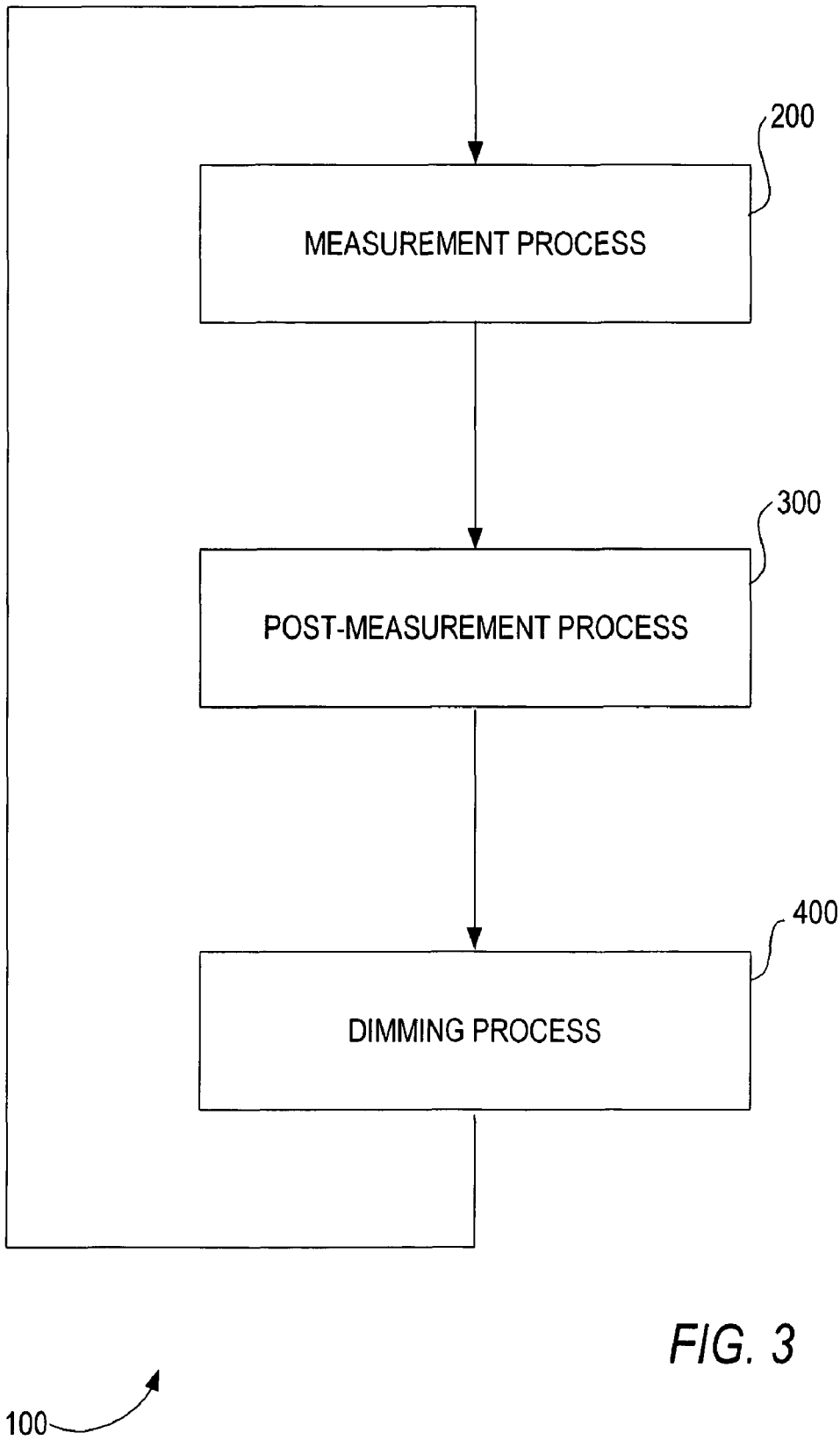
FIG. 3 is a high level flow chart of the process performed by the touch dimmer circuit of FIGS. 2A and 2B.

FIG. 3 shows a high level flow chart 100 of the process or algorithm which the controller U1 is configured to perform. First, measurement process block 200 measures the amount of time it takes to transfer charge from the capacitance of the touch pad to the measurement capacitor until it is fully charged when the touch pad is not being touched. The process also measures changes in touch pad capacitance caused by a user touching the touch pad. As explained above, when a user touches the touch pad, the total effective capacitance changes which affects the amount of (number of cycles) time it takes to charge the measurement capacitor using the capacitor of the touch pad. Post-measurement process block 300 includes a recalibration process which periodically measures the capacitance of the touch pad based on the number of cycles (a certain defined and known time period) it takes to fully charge the measurement capacitor. The controller performs an average of the number of cycles and develops a threshold that helps indicate whether a relatively large change (due to a user touching the touch pad) or relatively small change (due to stray capacitance) in the touch pad capacitance has occurred. The post-measurement process analyzes the number of cycles it takes to charge the measurement capacitor compared to the average number of cycles so as to determine whether the touch pad has been released as well as whether it is a "long" or "short" touch. Dimming process block 400 then determines whether to issue commands to change the brightness level (Bright/Dim) and/or the state (On/Off) of the light or other load. Once the dimming process block 400 has been executed, process 100 is repeatedly performed including executing processes 200 through 400. Processes 200 through 400 are described in further detail below.

Figure 4:
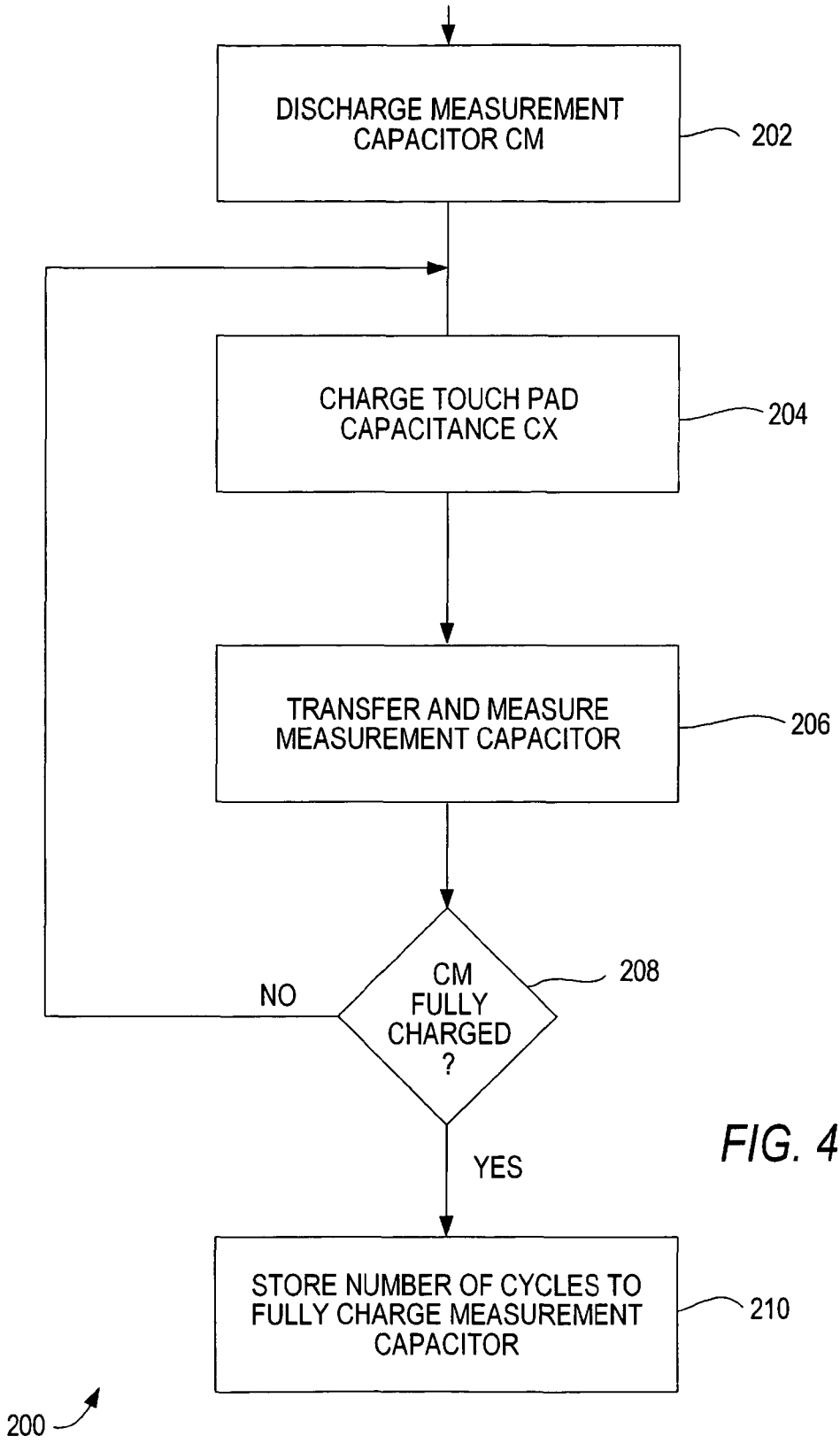
FIG. 4 is a detailed flow chart of the measurement process of FIG. 3.

FIG. 4 is a detailed flow chart of the measurement process 200 of FIG. 3 according to an embodiment of the invention. The measurement process 200 includes instructions for setting or programming the I/O Pins of controller U1 according to the steps or instructions of the process. The process involves charging the capacitance CX of the touch pad TP and transferring this charge to the measurement capacitance CM. This charging and transferring process is repeated until the measurement capacitor is fully charged and the process keeps track of the time (i.e., number of cycles) it takes to fully charge the measurement capacitor. When a user touches the touch pad TP, the capacitance CX of the touch pad is changed which affects the amount of charge across the touch pad. In turn, the change in charge affects the amount of time (number of cycles) to fully charge CM by repeatedly transferring charge from CX capacitor. This change in time can be used in a subsequent process to determine whether a user has touched or released the touch pad.

In one embodiment, at process step 202, to initialize the process, the controller U1 sets Pins 5, 7 to a Low state so to discharge measurement capacitor CM. To charge the touch pad TP, at process step 204, the controller U1 sets Pin 7 to a High-impedance state and Pin 5 to a High state allowing the capacitance CX of touch pad TP to charge. At process step 206, controller U1 sets Pin 7 to a Low state and Pin 5 to a High-impedance state allowing the transfer of charge from capacitance CX of the touch pad TP to measurement capacitor CM. The charging step 204 and the transferring step 206 are repeated until the measurement capacitor is fully charged. A fully charged Cm has a certain voltage level at Pin 5 when Pin 7 is grounded and Pin 5 is set to High impedance. The controller U1 keeps track of the number of cycles N that it takes to fully charge capacitor CM. At process step 208, controller U1 checks if the capacitor CM has been fully charged by checking if the voltage at Pin 5 has reached a predefined threshold value. If the threshold value has not been reached, controller U1 returns to process step 204 which involves further charging the capacitor CX until the value reaches the predefined value. On the other hand, if the threshold has been reached, process step 210 is executed which includes storing the number of cycles N for subsequent processing including the post-measurement process 300 described below.

Figure 5:
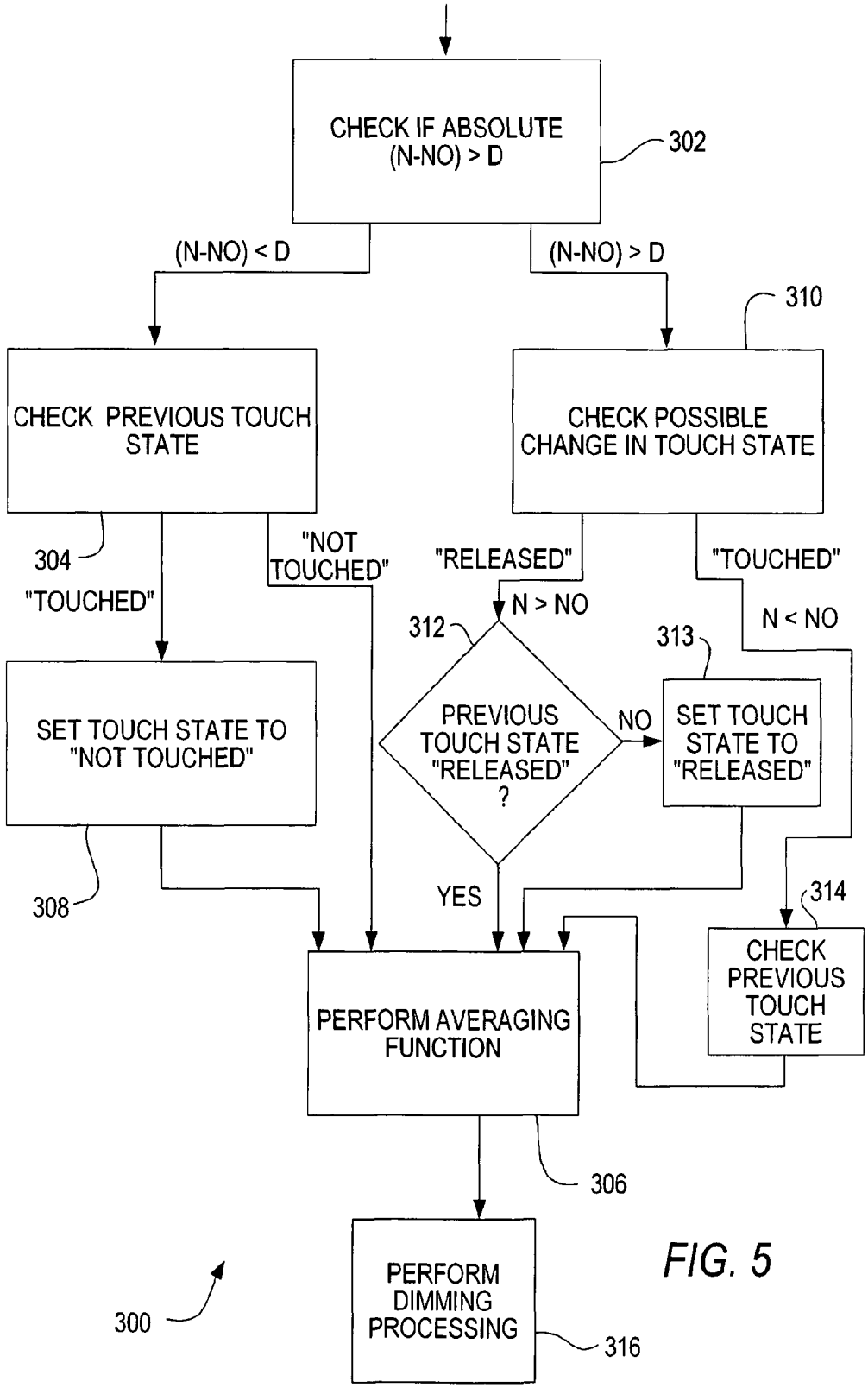
FIG. 5 is a detailed flow chart of the post-measurement process of FIG. 3.

FIG. 5 is a detailed flow chart of the post-measurement process 300 of FIG. 3 according to an embodiment of the invention. The measurement process above 200 involves measuring the number of cycles to fully charge the measurement capacitor when the touch pad is not being touched. When a user touches the touch pad, the capacitance of the touch pad is changed which affects the amount of time (number of cycles) it takes to transfer charge from the capacitance of the touch pad to the measurement capacitor to fully charge the measurement capacitor.

The post-measurement process 300 uses this change in the time to determine whether a user has touched or released the touch pad. The process also periodically measures the capacitance of the touch pad based on the number of cycles it takes to fully charge the measurement capacitor. The process performs an average of the number of cycles and develops a threshold that helps indicate whether a relatively large or significant change in the touch pad capacitance has occurred. Relatively small changes in the touch pad capacitance are typically due to environmental conditions and other conditions that create stray capacitances. A relatively large change in capacitance may be due to a user touching or releasing the touch pad. When the controller concludes that the touch pad has been touched it then determines whether the touch was a "long touch" or a "short touch."

The post-measurement process can employ the following parameters and values during operation. The value N represents the current number of cycles for charging the measurement capacitor CM. The value NØ represents the number of cycles to fully charge measurement capacitor CM when the touch pad is not touched and is the result of averaging the selected numbers of measurements represented by a predefined number NM. The parameter D is a threshold parameter which may be constant or variable depending on the dimmer state (On/Off), the current touch pad state ("touched," "not touched" and "released") and other factors. In addition, an upper and lower limit can be used to provide bounds within which the value of N can have.

To illustrate, suppose that the value of NØ is equal to 20 because it takes 20 cycles to fully charge the measurement capacitor CM when the touch pad is not being touched. Further suppose, that the threshold value D is set to the value 5 and the upper limit is set to 30 and the lower limit is set to 10. When a user touches the touch pad TP, the amount of capacitance across the touch pad increases which causes the number of cycles it takes to fully charge the measurement capacitor CM to decrease. For example, suppose N is determined to be equal to a value of 14. The algorithm compares the absolute value of the difference (N−NØ) to the value of the threshold D to determine whether a valid change has occurred. In this example, the absolute value of the difference (14−20) is equal to 6 which is greater than the threshold value D of 4. Thus, the calculation reveals that a valid "touch" event has occurred.

Now suppose that the user releases the touch pad TP. This action causes the amount of capacitance across the touch pad TP to decrease which causes the number of cycles to fully charge the measurement capacitor CM to increase. For example, N is determined to be equal to a value of 26. Again, the algorithm compares the absolute value of the difference (N−NØ) to the value of the threshold D. In this example, the absolute value of the difference (26−20) is equal to 6 which is greater than the threshold value D which has a value of 4. Thus, this calculation reveals that the touch pad has been "released." In addition, in the event the user touches the touch pad for a "long" time, the lower limit 10 provides a mechanism to detect such an event while the upper limit 30 provides a mechanism to detect when an upper limit has been reached.

The algorithm employs a recalibration process which helps reduce the undesirable impact of the environment such as stray capacitance on the measurement process. For example, the algorithm averages the charging cycle N (the time it takes to fully charge the measurement capacitor). It can perform the average a selected number of times NM. For example, in an ideal environment the number of cycles to fully charge the measurement capacitor CM is determined to be 10 and NM is selected to be 30. Now suppose that the environment has stray capacitance which adds to the capacitance CX of the touch pad TP causing the value N to decrease slightly to a value of 9. The algorithm detects this slight change and ignores it because it does not exceed the threshold calculation described above. Moreover, the recalibration process averages the time it takes to fully charge the measurement capacitor NM times (30) resulting in N being set to the value 9. This technique helps handle relatively small changes in the touch pad capacitance which are typically due to environmental conditions (e.g., stray capacitance).

Referring an embodiment of the post-measurement algorithm 300, at process step 302, the algorithm compares the current measurement value of N and NØ with D. In particular, if the absolute value of (N−NØ) is less than the value of D, such a result indicates that the number of current of cycles N is close to the number of cycles NØ for fully charging the measurement capacitor when the touch pad is not being touched by a user. This means it will require further processing before it is possible to determine whether a valid "touch" or "released" state has occurred. In this case, the algorithm executes process step 304. On the other hand, if the absolute value of (N−NØ) is greater than the value of D, then such a result indicates that the touch pad state may have changed and so the algorithm executes process step 310 for further analysis.

At process step 304, the algorithm checks the previous touch pad state. If the value of the previous state of the touch pad is equal to the "not-touched" state, then this event may represent an unwanted environmental condition (stray capacitance). In this case, the algorithm executes process step 306 to continue to average the measured number of cycles N which helps recalibrate the measurement process. On the other hand, if the value of the previous state of the touch pad is equal to the "touched" state then the algorithm executes process step 308.

At process step 306, the algorithm performs an averaging function and then updates the value of NØ if the selected number of measurements NM has been averaged. The algorithm then terminates the post-measurement process 300 and proceeds to process step 316 to execute the dimming process 400 described in further detail below. In addition, the recalibration process explained above is implemented by continuously performing the averaging function to help the dimmer circuit operate in different environments and changing temperature conditions.

At process step 308, the algorithm checks the state of the touch pad to determine whether there has been a change in the touch pad state from the "touched" state to the "untouched" state. The value of the previous touch pad state is equal to the "touched" state and the measured number of cycles N (after debouncing) is compared to the value NØ. (Debouncing involves further processing the measurements to reduce the occurrence of accidental glitches.) As explained above, NØ represents the number of cycles to fully charge the measurement capacitor when the touch pad is not being touched. Therefore, if N is close in value to NØ, then such a result indicates that the touch pad is not being touched so the algorithm sets the value of the touch pad state to the "not touched" state and performs the averaging function at process step 306.

At process step 310, the algorithm compares the value of N to NØ to determine if there is a possible change in touch pad state. The value N represents the current number of cycles for charging the measurement capacitor and NØ represents the number of cycles it took to fully charge the measurement capacitor when the touch pad was not touched by a user. When a user touches the touch pad, the number of cycles N to fully charge the measurement capacitor CM is smaller than NØ. On the other hand, when a user releases the touch pad, the number of cycles N to fully charge the measurement capacitor CM is larger than NØ. Therefore, a value of N is less than NØ indicates that the touch pad is being touched by a user and so the value of the state of touch pad is set to the "touched" state. On the other hand, a value of N greater than NØ indicates that the touch pad is being released and so the value of the state of the touch pad is set to the "released" state. The value of the state of the touch pad is debounced to reduce the occurrence of noise or glitches. After the value of the touch pad is debounced, the algorithm sets the current value of the touch pad state to the "released" state and proceeds to process step 312. Otherwise, if the value of the touch pad state is equal to the "touched" state, then the algorithm proceeds to process step 314.

At process step 312, the algorithm compares the current state of the touch pad to the previous state of the touch pad to determine whether there has been a change in state. The current state of the touch pad is "released." If the previous state of the touch pad is equal to the "released" state, then the algorithm continues to perform the average process at step 306 because it is still is in the release state. On the other hand, if the value of the previous state is equal to the "touched" state, then the algorithm, at block 313, changes the state to the "released" state and initializes and executes the averaging procedure at process 306.

At process step 314, the algorithm checks the value of the previous state of the touch pad. The current value of the touch pad state is "touched." If the value of the previous touch pad state is equal to the "released" state, then the algorithm changes the value to the "touched" state and executes the dimming process 400 without using the current measurement from the averaging process step 306. On the other hand, if the previous touch pad state was equal to the "touched" state, then the algorithm performs the following additional determinations: If the touch pad has been intentionally touched (for example, to continue dimming operations), then the measured value N used for averaging is discarded because it may distort the proper value of the untouched pad measurements NØ. However, if the change is permanent due to environment, temperature changes or some object in proximity to the touch pad, then the algorithm initiates the recalibration process which obtains a new value for the constant NØ. This technique helps make it possible to continue to operate the dimmer circuit in changing environmental conditions.

The algorithm may employ the following criteria during the execution of process step 314. If the brightness level of the dimmer is not set at a maximum brightness level and the state of the dimmer is not in the Off state, then the averaging procedure at process step 306 is initialized and processing is terminated at process step 306. On the other hand, if the dimmer state is equal to the Off state or if the level has reached a maximum brightness level (there is no longer a reason to continue to hold the touch pad, so most likely the value NM has to be changed) then the algorithm continues to perform the averaging procedure at process step 306 without initializing the averaging procedure. The process eventually changes the value of the constant NM and sets the state of the touch pad to the "released" state.

This process helps improve the error tolerance between the calculation of the raw measurements from the measurement process 200 above (i.e., the number of cycles N of the measurement process used to charge the measurement capacitor CM) and the dimming process 400 below (i.e., commands to change the level/state of the dimmer circuit). All measurements may be repeated synchronously with the zero-crossing signal (e.g., at half cycle and full cycle intervals) after each zero-crossing signal and before issuing a signal to trigger (fire) the TRIAC. Such a technique may help improve the performance of the dimmer by reducing the occurrence of any potential electrical noise during load switching.

Figure 6:
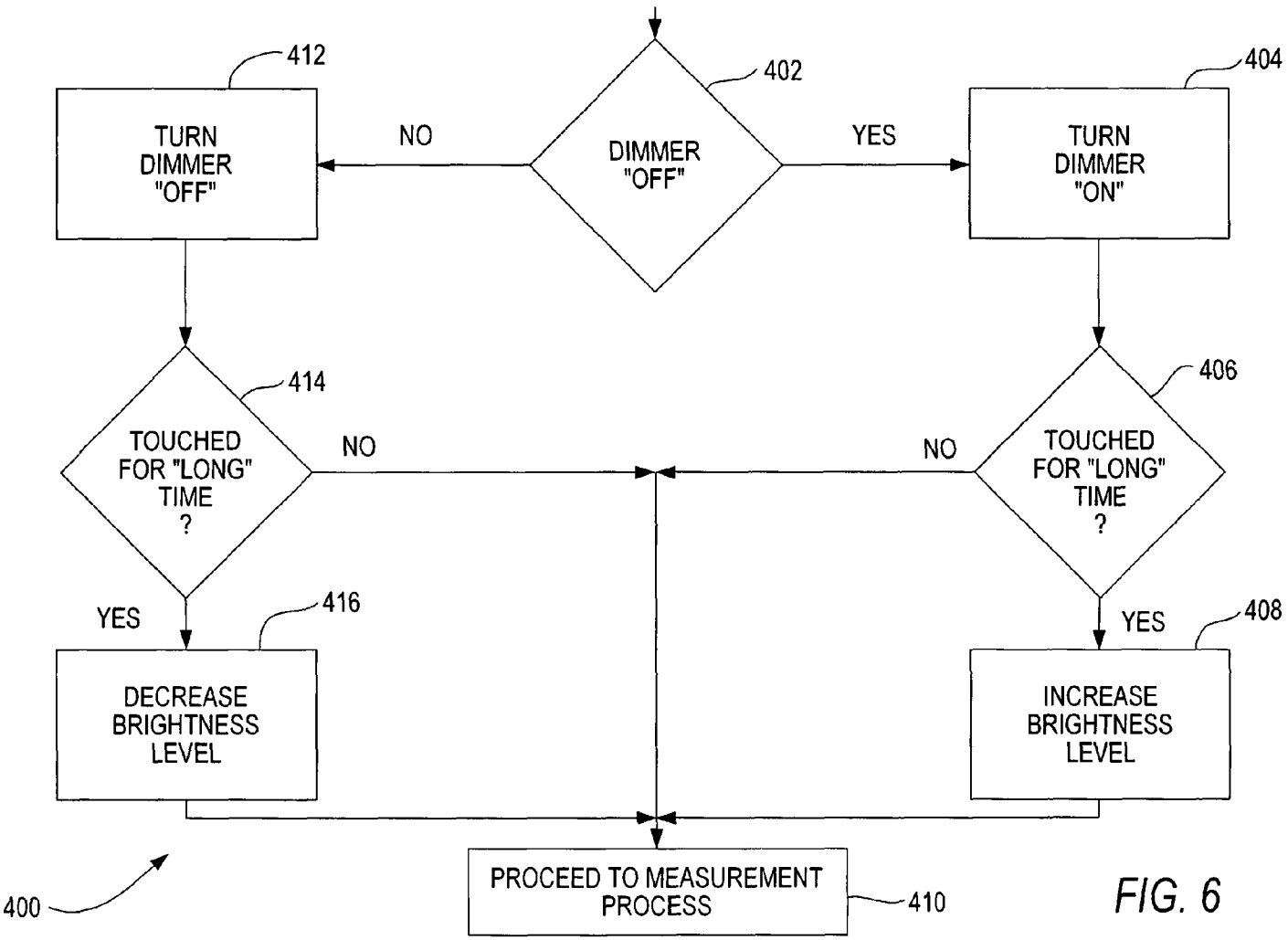
FIG. 6 is a detailed flow chart of the dimming process of FIG. 3.

FIG. 6 is a detailed flow chart of the dimming process 400 of FIG. 3. The dimming process 400 includes an algorithm to control the brightness level and state of the dimmer. When a user continuously touches the touch pad TP for a relatively "long" time period and the light of the dimmer is Off, then not only is the light turned On but the dimmer increases the intensity of the light to a maximum brightness level. However, when the light of the dimmer is already On and a user continuously touches the touch pad TP for a relatively "long" time period, then the intensity of the light is reduced to a minimum brightness level and then turned Off. The process handles events such as "short" touch followed by a "long" touch which causes the direction of fading to change or toggle.

In one embodiment, at process step 402, the algorithm checks the state of the dimmer (On/Off). It is assumed that the touch pad has been touched. If the current dimmer state is equal to the Off state (light is Off), then the algorithm executes process step 404 which includes setting the light of the dimmer to the On state and setting the brightness level to a previously set level. Then, the algorithm executes process step 406 which includes checking the duration of time that the touch pad has been pressed. If the touch pad has been touched continuously for a relatively "long" predefined time, the algorithm executes process step 408 which includes adjusting (fading) the brightness level of the light to a maximum brightness level without changing the previously set level.

On the other hand, when the touch pad is touched and the current state of the dimmer light is equal to On (light is On), then at process step 402, then the algorithm executes process step 412 which includes setting the state of the dimmer to the Off state (light Off). Then the algorithm executes step 414 which includes checking the duration of time that the touch pad has been touched. If the touch pad has been touched for a relatively "long" predefined period of time (e.g., more than approximately 0.5 seconds), then the algorithm executes step 416 which includes decreasing the brightness level of the light while the touch pad is touched. Each time the touch pad is touched, the direction of dimming (fading) toggles. At process step 410, the algorithm terminates the dimming process and returns back to the measurement process 200.

Figure 7:
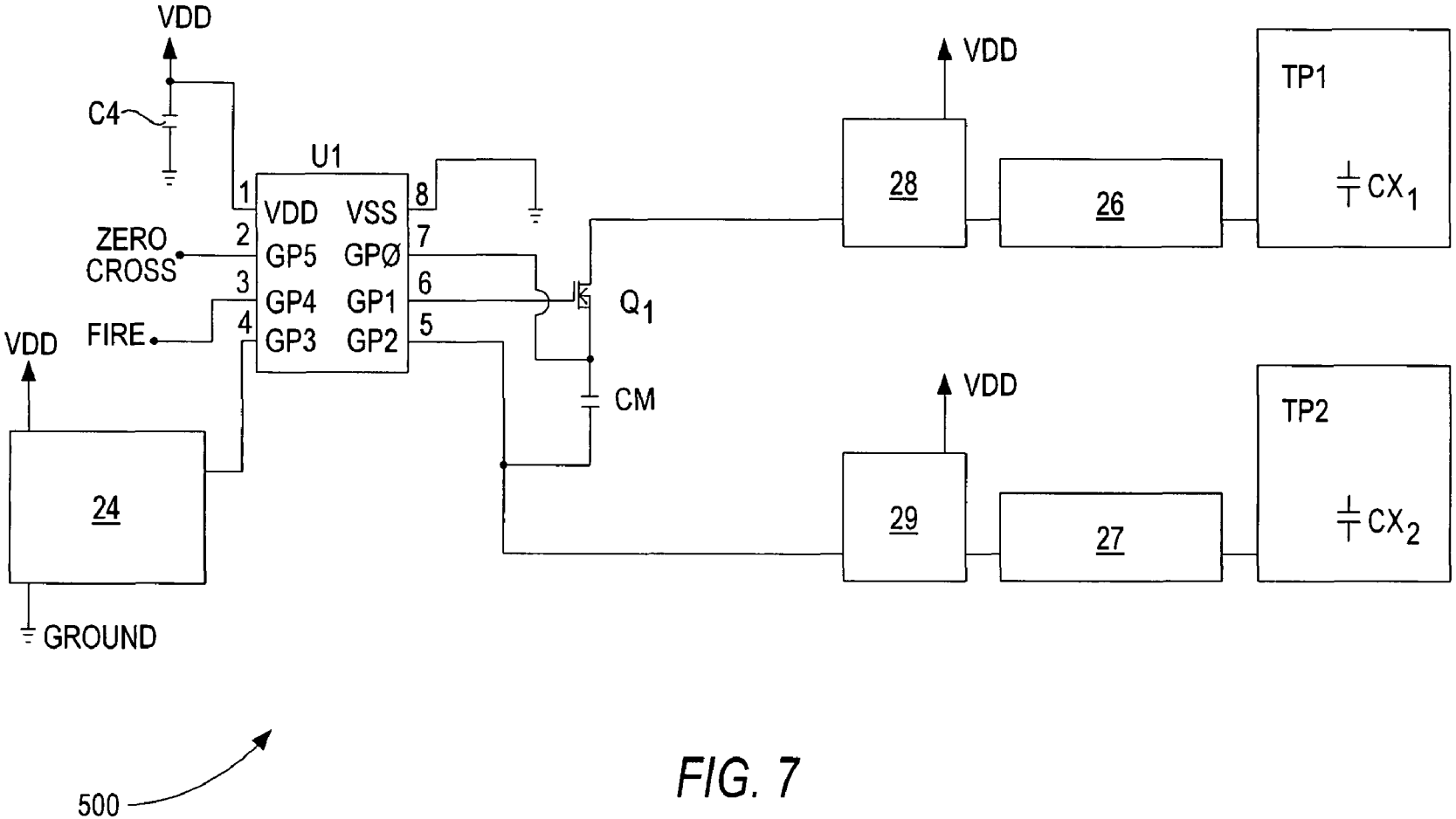
FIGS. 7 to 11 are schematic circuit diagrams of toggle dimmer circuits according to various embodiments of the present invention.

FIG. 7 is a schematic circuit diagram of an embodiment of a capacitance sense toggle dimmer circuit 500. The circuit 500 is similar to the touch dimmer circuit of FIGS. 2A, 2B except that circuit 500 is configured to increase/decrease (fade or dim) the brightness level of the light in response to a user touching a pair of touch pads TP1, TP2. Furthermore, touch pad TP2 has current limiting circuitry 27 and ESD protection circuitry 29 similar to the circuitry 26, 28 for touch pad TP1. Touch pads TP1, TP2 have respective inherent capacitances CX1, CX2 but share a common measurement capacitor CM and transistor switch Q1. Touch pad TP1 is connected to one terminal of transistor switch Q1 through circuitry 26, 28. Likewise, touch pad TP2 is connected to the other terminal of transistor Q1 through circuitry 27, 29 and measurement capacitor CM. The control gate terminal of switch Q1 is connected to Pin 6 of controller U1 to control the operation of switch Q1 according to the techniques described in the current application. Although not shown, the Fire terminal and the ZeroCross terminals are connected to a power switching circuit such as circuit 16 shown in FIG. 2B. Transistor Q1 is shown as an n-channel MOSFET but other switching means can be employed to provide a similar switching function.

The controller U1 is configured according to the techniques of the present invention as described above. For example, the controller can measure changes in capacitance CX1 of the first touch TP1 and changes in capacitance CX2 of the second touch pad TP2 by controlling the conduction of switch Q1. In one embodiment, a separate measurement process can be employed for each touch pad. For example, the measurement process can include alternate between charging and transferring charge from the first touch pad TP1 to the common measurement capacitor CM and charging and transferring charge from the second touch pad TP2 to the capacitor.

In alternate time slots or cycles of the measurement process, the controller U1 can cause switch Q1 to conduct to provide electrical paths from the touch pads TP1, TP2 to the measurement capacitor. This "multiplexing" technique allows two touch pads to share a single common measurement capacitor.

The algorithm employed by the toggle dimmer circuit 500 of FIG. 7 is similar to the algorithm utilized by the touch dimmer circuit of above. For example, the post-measurement process employed by circuit 500 is similar to the post-measurement process 300 of FIG. 5. In this case, the measurements are repeated independently for each state of switch Q1, for example, every other half cycle of a zero-crossing point of an AC cycle. When switch Q1 is closed (conduction state), the touch pad TP2 circuitry is connected to capacitor CM and the measurements reflect the capacitance of both touch pads. When switch Q1 is open (non-conduction state), the measurements reflect only the capacitance of touch pad TP1. The averaging procedure of process step 306 of FIG. 5 is also employed independently for each state of switch Q1.

The following describes additional differences between the post-measurement process for the toggle dimmer circuit and the touch dimmer circuit above. For circuit 500, the value NØØ represents the average number of cycles to fully charge measurement capacitor when switch Q1 is open (non-conduction) and NØ1 represents the number of cycles when switch Q1 is closed (conduction). The value NØ represents the measured number of charge cycles when switch Q1 is open and N1 represents the measured number of charge cycles when switch Q1 is closed. If NØ is less than NØØ, then most likely touch pad TP1 was touched. If N1 is less than NØ1, then most likely one of the touch pads TP1, TP2 has been touched. In addition, the algorithm compares the absolute value of (NØ−NØØ) to the value of DØ. The parameter threshold DØ represents a threshold value that is constant or variable depending on the touch pad TP1 state (touch/not-touched) and dimmer state (On/Off). If the absolute value of (NØ−NØØ) is less than the value of DØ, then most likely touch pad TP1 was touched. In addition, when the value of NØ is both substantially equal to the value of NØØ and the absolute value of (N1−NØ1) is less than the value of D1, then most likely touch pad TP2 was touched. The parameter threshold D1 represents a threshold value that is constant or variable depending on the touch pad TP2 state (touch/not-touched) and dimmer state (On/Off).

In addition, the following differences exist between the post-measurement process of circuit 500 and the post-measurement process 314 shown in FIG. 5. For example, if the brightness level of the dimmer is not set to a maximum or minimum brightness level, then the averaging procedure at process step 306 is initialized and the process is terminated at process step 306. On the other hand, if the brightness level of the dimmer has reached a maximum or minimum brightness level (the user is probably no longer touching the touch pad, so most likely constants NØØ and NØ1 have to be changed), then the process continues with the average measurements at process step 306 without initializing the step. As a result, the constant values NØØ and NØ1 are changed and the touch pad is set to the "released" state. It should be noted that because the value of the measurement capacitor CM is different when both touch pads TP1, TP2 are attached or just when one pad is attached, different parameter thresholds DØ, D1 can be utilized for the definition of a "touched" state.

FIGS. 8 through 11 are schematic circuit diagrams of various embodiments of a capacitance sense toggle dimmer circuit.

Figure 8:
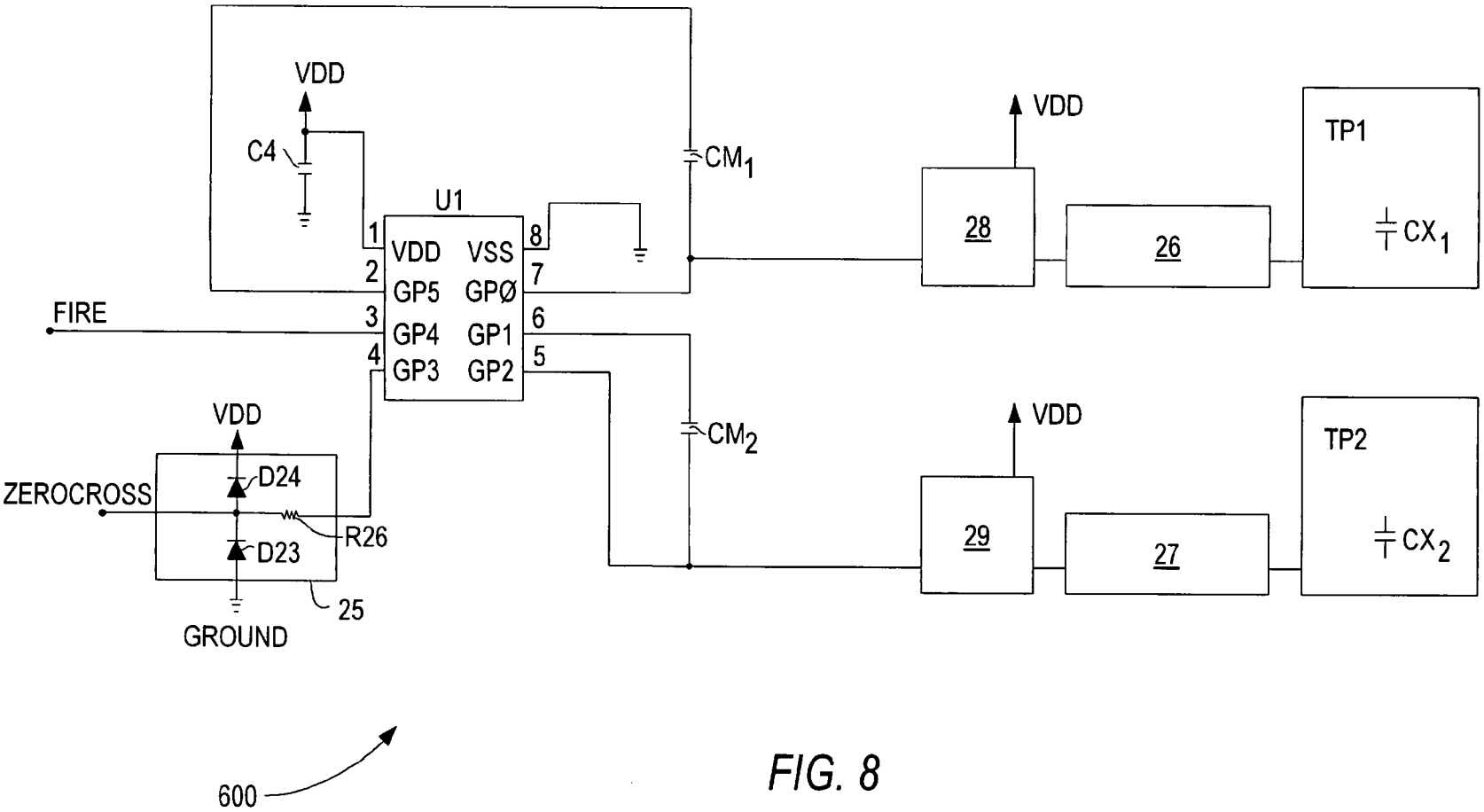

Referring to FIG. 8, there is shown a toggle dimmer circuit 600 similar to dimmer circuit 500 of FIG. 7 in that both circuits employ a pair of touch pads TP1, TP2 connected to respective ESD circuitry 28, 29 and current limiting circuitry 26, 27. However, circuit 600 does not employ a transistor switch or employ a common measurement capacitor. Instead, touch pads TP1, TP2 are connected to respective measurement capacitors CM1, CM2. Measurement capacitor CM1 is connected across Pins 2 and 7 of controller U1 whereas measurement capacitor CM2 is connected across Pins 5 and 6 of the controller. In addition, a zero-crossing signal is fed to Pin 4 of controller U1 through a reference circuit 25 that includes voltage limiting diodes D23, D24 and resistor R26 instead of reference circuit 24 of FIG. 2A.

The controller U1 is configured according to the techniques of the present invention as described above. For example, the controller U1 measures changes in capacitance CX1 of the first touch TP1 by controlling Pins 2 and 7 as well as changes in capacitance CX2 of the second touch pad TP2 by controlling Pins 5 and 6. In one embodiment, a separate measurement process can be employed for each touch pad. For example, the measurement process for the second touch pad TP2 can include charging the capacitance CX2 of the touch pad TP2 and transferring this charge to corresponding measurement capacitance CM2 and repeating this process until the measurement capacitor CM2 is fully charged. In particular, a charge step of the measurement process can include setting Pin 6 to a High-impedance state and Pin 5 to a High state which causes charge to flow from Pin 5 to the capacitance CX2 of touch pad TP2. Next, in a transfer step of the measurement process, Pin 6 is set to a Low state and Pin 5 is set to a High-impedance state which causes the charge on the capacitance CX2 to be transferred to the measurement capacitor CM2. These charge and transfer steps are repeated until the measurement capacitor CM2 is fully charged. The controller U1 keeps track of the time period (number of cycles) to fully charge the measurement capacitor CM2. The process also detects "touch" and "release" events by comparing the time it takes to charge the measurement capacitor when it is not being touched to the time it takes to charge a measurement capacitor when it is being touched.

Figure 9:
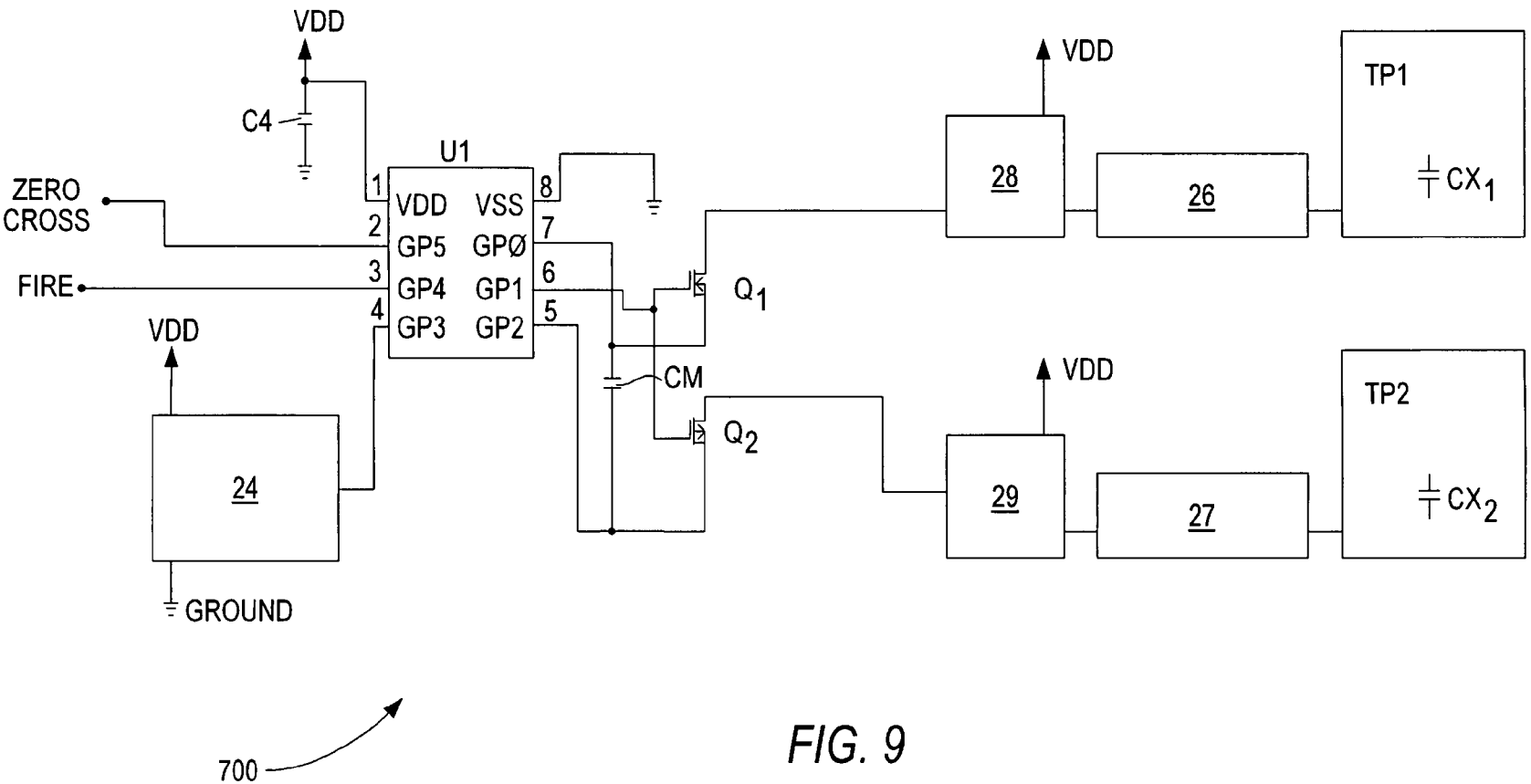

Referring to FIG. 9, there is shown a schematic circuit diagram of another embodiment of a capacitance sense toggle dimmer circuit 700. Dimmer circuit 700 is similar to dimmer circuit 600 of FIG. 8 in that dimmer circuit 700 includes a pair of touch pads TP1, TP2. However, the touch pads TP1, TP2 are associated with respective transistor switches Q1, Q2 and share a common measurement capacitor CM which is connected across pins 5 and 7 of controller U1. The gate terminals of switches Q1, Q2 are connected together and to pin 6 of controller U1. The source terminals of switches Q1, Q2 are connected to a respective end of the common measurement capacitor CM. The drain terminals of switches Q1, Q2 are connected to respective touch pads TP1, TP2 through respective ESD circuits 28, 29 and leakage limiting circuits 26, 27. Transistor Q1 is shown as an n-channel MOSFET and transistor Q2 is shown as a p-channel MOSFET but other switching means can be employed to provide a similar switching function.

The controller U1 is configured according to the techniques of the present invention to measure changes in capacitance CX1 of the first touch TP1 by controlling the conduction of switch Q1 and measure changes in capacitance CX2 of the second touch pad TP2 by controlling the conduction of switch Q2. In one embodiment, a separate measurement process can be employed for each touch pad. For example, the measurement process can alternately charge and transfer charge from the first touch pad TP1 and the second touch pad TP2 to the common measurement capacitor CM. In one time slot or cycle of the measurement process, the controller U1 causes switch Q1 to conduct and switch Q2 to not conduct which provides an electrical path from the first touch pad TP1 to measurement capacitor CM but no electrical path between the second touch pad TP2 and the capacitor CM. In a subsequent next time slot or cycle of the measurement process, the conduction of the switches is reversed. That is, the controller U1 causes switch Q1 to not conduct and switch Q2 to conduct which provides an electrical path from the second touch pad TP2 to measurement capacitor CM but no electrical path between the first touch pad TP1 and the capacitor CM. This "multiplexing" technique allows two touch pads to share a single common measurement capacitor.

Figure 10:
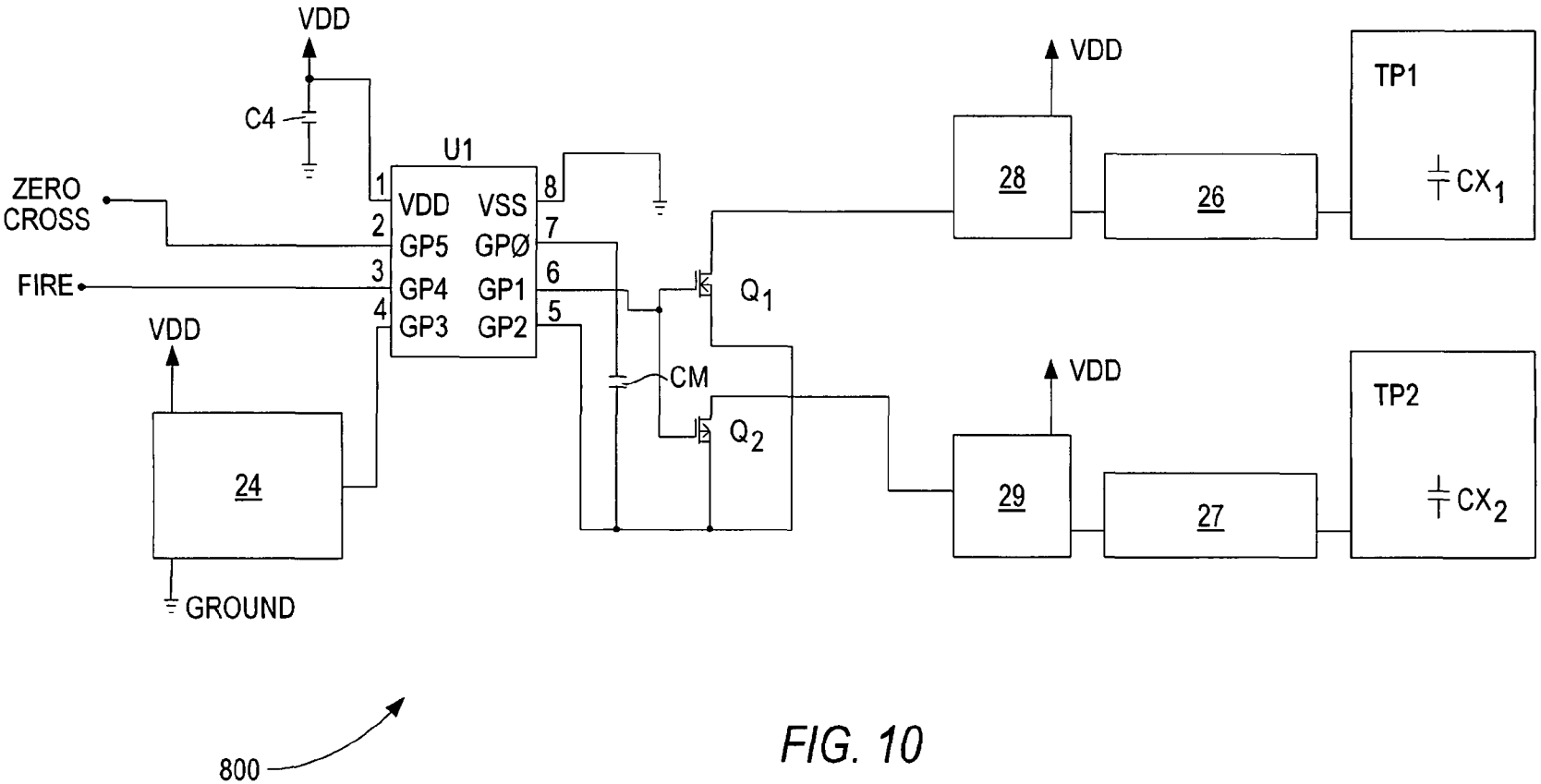

Referring to FIG. 10, there is shown a schematic circuit diagram of another embodiment of a capacitance sense toggle dimmer circuit 800. Dimmer circuit 800 is similar to circuit 700 of FIG. 9 in that touch pads TP1, TP2 are associated with respective transistor switches Q1, Q2. In addition, the drain terminals of switches Q1, Q2 are connected to respective touch pads TP1, TP2 through respective ESD circuits 28, 29 and leakage limiting circuits 26, 27. A common measurement capacitor CM is connected across pins 5 and 7 of controller U1. However, in circuit 800, the source terminal of each transistor is connected together and to one end of the common measurement capacitor CM. The controller U1 is configured according to the techniques of the present invention to measure changes in capacitance of the first touch TP1 and the second touch pad TP2 by controlling the conduction of switches Q1, Q2 similar to the operation of the toggle circuit 700 of FIG. 9. This "multiplexing" technique allows two touch pads to share a single common measurement capacitor CM.

Figure 11:
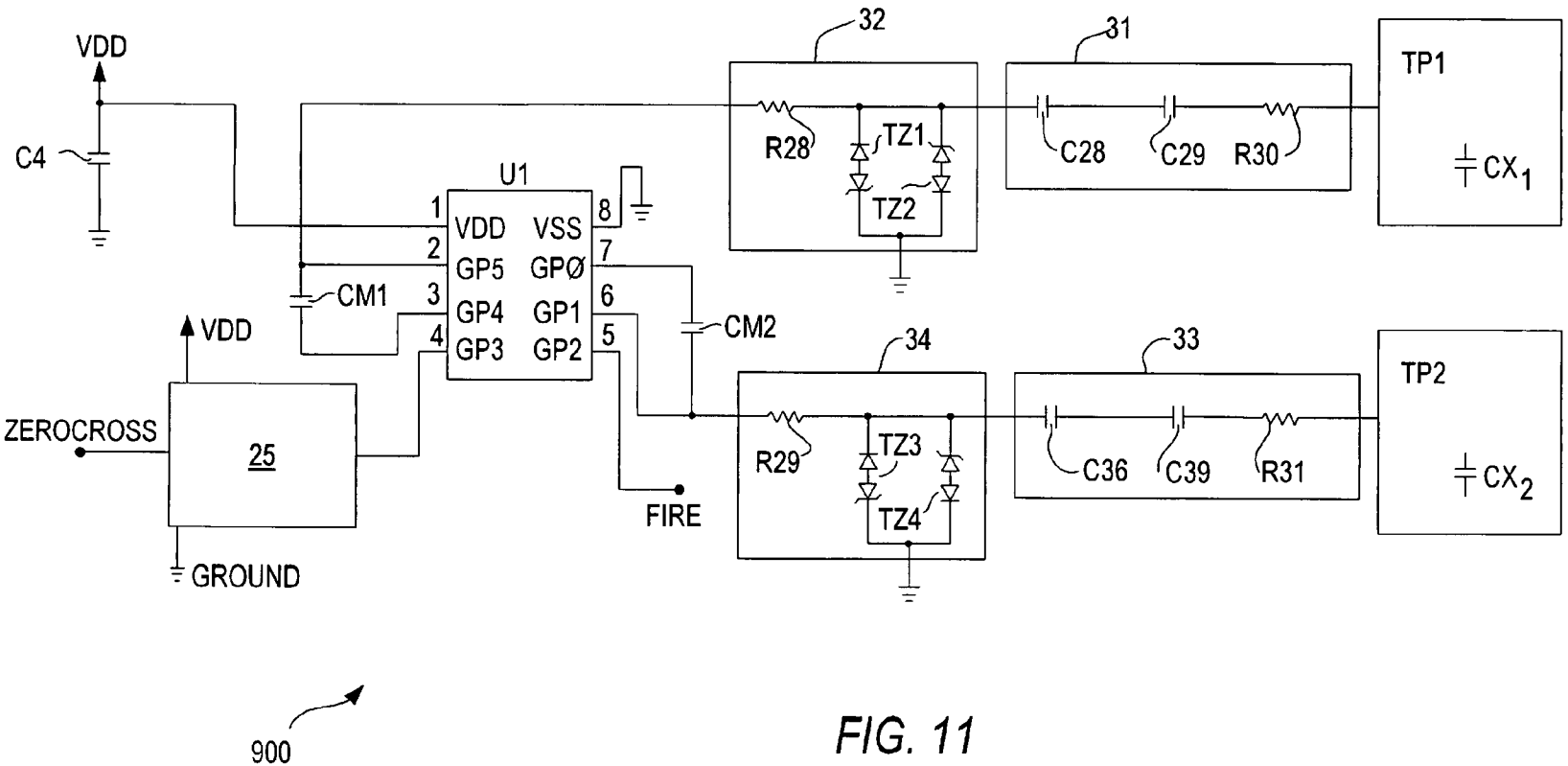

Referring to FIG. 11, there is shown a schematic circuit diagram of another embodiment of a capacitance sense toggle dimmer circuit 900. Dimmer circuit 900 is similar to dimmer circuit 600 of FIG. 8 except that in circuit 900 touch pad TP1 is connected to an ESD circuit 32 comprising a pair of TVS diodes TZ1, TZ2 and a resistor R28 for handling positive and negative transients. In addition, touch pad TP1 is coupled to a current limiting circuit 31 comprising series connected capacitors C28, C29 and resistor R30. Likewise, touch pad TP2 is connected to an ESD circuit 34 comprising a pair of TVS diodes TZ3, TZ4 and a resistor R29 for handling positive and negative transients. Also, the touch pad TP2 is coupled to a current limiting circuit 33 comprising series connected capacitors C36, C39 and resistor R31. The controller U1 is configured according to the techniques of the present invention such as the measurement technique employed by circuit 600 of FIG. 8 described above. For example, the controller U1 measures changes in capacitance of the first touch TP1 by controlling Pins 2 and 3 as well as changes in capacitance of the second touch pad TP2 by controlling Pins 6 and 7.

The operation of the above toggle dimmer circuits 600, 700, 800 and 900 is similar to the operation of toggle dimmer circuit 500 including the process for measuring changes in capacitance of CX1, CX2 and controlling a load based on such measurements. Although not shown, it is contemplated that the toggle dimmer circuits are to be coupled to a power switching circuit such as circuit 16 shown above in FIG. 2B or other similar circuit. As mentioned above, in response to the above measurements, controller U1 generates trigger signals directed to the power switch circuit 16 to control the brightness and state of a load.

It should be noted that although the techniques of the present invention have been described in the context of a light bulb, it should be understood that the techniques are equally applicable to other applications such as a ceiling fan or other electrical devices.

While there have been shown and described and pointed out the fundamental novel features of the invention as applied to the preferred embodiments, it will be understood that various omissions and substitutions and changes of the form and details of the devices illustrated and in their operation may be made by those skilled in the art without departing from the spirit of the invention.

What is claimed is:

1. A touch dimmer circuit comprising:

a controller coupled to a measurement capacitor and also coupled via protection circuitry to a touch pad whose change in capacitance is detected by the controller so as to control AC current flow through a lighting load connected to the touch dimmer circuit and to a power source;

wherein the controller is configured to receive a zero-crossing signal to synchronize the operation of the controller.

2. The touch dimmer circuit of claim 1 where the controller is configured to generate control signals for controlling a load in response to the measurements.

3. The touch dimmer circuit of claim 1 wherein the protection circuitry includes an electrostatic discharge (ESD) protection circuit.

4. The touch dimmer circuit of claim 1 wherein the protection circuitry includes a current limiting circuit comprising one or more serially connected capacitors.

5. A toggle dimmer circuit comprising: a controller coupled to a first measurement capacitor and also coupled via a first protection circuitry to a first touch pad whose change in capacitance is detected by the controller when the controller causes a transfer of charge from the first touch pad to the first measurement capacitor to occur, and the controller is coupled to a second measurement capacitor and also coupled via a second protection circuitry to a second touch pad whose change in capacitance is detected by the controller when the controller causes a transfer of charge from the second touch pad to the second measurement capacitor to occur;

wherein the controller is configured to control AC current flow through a lighting load connected to the toggle dimmer circuit and to a power source.

6. The toggle dimmer circuit of claim 5 where the controller is configured to receive a zero-crossing signal to synchronize the operation of the controller.

7. The toggle dimmer circuit of claim 5 where the controller is configured to generate control signals for controlling a load in response to the measurements.

8. The toggle dimmer circuit of claim 5 wherein the first protection circuitry includes an electrostatic discharge (ESD) protection circuit.

9. The toggle dimmer circuit of claim 5 wherein the second protection circuitry includes an electrostatic discharge (ESD) protection circuit.

10. The toggle dimmer circuit of claim 5 wherein the first protection circuitry includes a current limiting circuit comprising one or more serially connected capacitors.

11. The toggle dimmer circuit of claim 5 wherein the second protection circuitry includes a current limiting circuit comprising one or more serially connected capacitors.

12. A toggle dimmer circuit comprising: a controller coupled to a measurement capacitor and also coupled via a first protection circuitry to a first touch pad whose change in capacitance is detected by the controller when the controller causes a transfer of charge from the first touch pad to the measurement capacitor to occur, and the controller is coupled via a second protection circuitry to a second touch pad whose change in capacitance is detected by the controller when the controller causes a transfer of charge from the second touch pad to the measurement capacitor to occur;

wherein the controller is configured to control AC current flow through a lighting load connected to the toggle dimmer circuit and to a power source.

13. The toggle dimmer circuit of claim 12 where the controller is configured to receive a zero-crossing signal to synchronize the operation of the controller.

14. The toggle dimmer circuit of claim 12 where the controller is configured to generate control signals for controlling a load in response to the measurements.

15. The toggle dimmer circuit of claim 12 wherein the first protection circuitry includes an electrostatic discharge (ESD) protection circuit.

16. The toggle dimmer circuit of claim 12 wherein the second protection circuitry includes an electrostatic discharge (ESD) protection circuit.

17. The toggle dimmer circuit of claim 12 wherein the first protection circuitry includes a current limiting circuit comprising one or more serially connected capacitors.

18. The toggle dimmer circuit of claim 12 wherein the second protection circuitry includes a current limiting circuit comprising one or more serially connected capacitors.

* * * * *